US010905220B2

(12) United States Patent
Lee

(10) Patent No.: US 10,905,220 B2
(45) Date of Patent: Feb. 2, 2021

(54) COSMETIC STAMP CONFIGURATION AND METHOD FOR USING THE SAME

(71) Applicant: Kiss Nail Products, Inc., Port Washington, NY (US)

(72) Inventor: Youl Mae Lee, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 260 days.

(21) Appl. No.: 15/821,144

(22) Filed: Nov. 22, 2017

(65) Prior Publication Data

US 2019/0150594 A1 May 23, 2019

(51) Int. Cl.

| | |
|---|---|
| ***A45D 40/30*** | (2006.01) |
| ***A45D 40/26*** | (2006.01) |
| ***A45D 42/02*** | (2006.01) |
| ***A45D 40/22*** | (2006.01) |
| ***A45D 33/00*** | (2006.01) |
| ***A45D 34/04*** | (2006.01) |

(52) U.S. Cl.

CPC ..... *A45D 40/30* (2013.01); *A45D 33/008* (2013.01); *A45D 34/04* (2013.01); *A45D 40/22* (2013.01); *A45D 40/26* (2013.01); *A45D 42/02* (2013.01)

(58) Field of Classification Search

CPC ..... A45D 40/26; A45D 40/30; A45D 40/24; A45D 40/262; A45D 40/22; A45D 40/0068; A45D 40/265; A45D 33/18; A45D 33/24; A45D 33/36; A45D 2040/0012; B41K 1/006; B41K 1/04; B41K 1/56

USPC ..... 206/371, 214, 485.1, 823; 101/372; 220/507

See application file for complete search history.

(56) References Cited

U.S. PATENT DOCUMENTS

| | | | | |
|---|---|---|---|---|
| 963,212 | A * | 7/1910 | Davis | |
| 1,632,864 | A * | 6/1927 | Weber | A45D 33/28 132/294 |
| 2,998,821 | A * | 9/1961 | Hurdel | A45D 40/30 132/218 |
| 3,132,652 | A * | 5/1964 | Gazdik | A45D 33/28 132/297 |
| 3,480,371 | A * | 11/1969 | Lee | B43M 99/006 401/121 |
| 5,450,791 | A * | 9/1995 | Prohm | B41F 17/30 101/333 |
| 7,874,298 | B2 * | 1/2011 | Malick | A45D 29/004 132/200 |

(Continued)

*Primary Examiner* — Rachel R Steitz
*Assistant Examiner* — Brianne E Kalach
(74) *Attorney, Agent, or Firm* — Cherskov Flaynik & Gurda, LLC

(57) ABSTRACT

A cosmetic stamp configuration can be provided, which can include, e.g., a stamping element body. The exemplary stamp configuration can also include a first cosmetic stamping element removably coupled or inserted to a first side of the stamping element body, and a second cosmetic stamping element removably coupled or inserted to a second side of the stamping element body. The second side can be different and provided away from the first side. Further, at least one cosmetic component can be provide that is housed in the stamping element body. Additionally, exemplary methods can be provided for instruct with the usage and assembly of such cosmetic stamp configuration.

15 Claims, 7 Drawing Sheets

(56) References Cited

U.S. PATENT DOCUMENTS

| | | | | |
|---|---|---|---|---|
| 2002/0175136 | A1* | 11/2002 | Bouix | B65D 23/0821 215/12.2 |
| 2005/0000850 | A1* | 1/2005 | Young | A45D 40/24 206/581 |
| 2010/0307521 | A1* | 12/2010 | Pires | A45D 33/006 132/200 |
| 2011/0088710 | A1* | 4/2011 | Lampugnale | A45D 29/11 132/75 |
| 2011/0293352 | A1* | 12/2011 | Kim | A45D 40/24 401/122 |
| 2015/0201733 | A1* | 7/2015 | Brogoitti | A45D 33/22 132/288 |
| 2017/0295908 | A1* | 10/2017 | Lee | B41K 1/04 |

* cited by examiner

COSMETIC STAMP CONFIGURATION AND METHOD FOR USING THE SAME

FIELD OF THE DISCLOSURE

The present disclosure relates generally to cosmetics, and more specifically, to exemplary embodiments of exemplary cosmetic stamp configurations and methods for using the same.

BACKGROUND INFORMATION

Cosmetic stamps can be typically used by consumers for a number of different cosmetic applications such as, e.g., stamping a cosmetic eyebrow, a cosmetic lip, or a cosmetic mustache. In applying a cosmetic stamp, a user can typically purchase a stamp having a particular design, a stamp application pen for applying ink to the stamp, and a container for holding the stamp. These devices can be sold separately, and be provided in separate containers. To apply the stamp, the user typically performs a complicated process of applying ink to the face of the cosmetic stamp using a stamp application pen.

After use and wear of a cosmetic stamp, the cosmetic stamp is usually cleaned using a complicated cleaning procedure. For example, the eyebrow stamp may have to be removed from its base, and cleaned with soap and water. An eyebrow brush can be provided for cleaning the eyebrow stamp. The eyebrow stamp should then be reattached to its base. Further, the stamp application pen must be cared for as well. It is recommended that the pen be stored tip down in a cup or holder to allow the tip to stay moist and not dry out. Additionally, if the pen tip dries out, the pen must be stored tip down until it re-hydrates with the fluid stored in the storage compartment thereof.

Thus, it may be beneficial to provide cosmetic stamp configuration which can overcome at least some of the deficiencies described herein above.

SUMMARY OF EXEMPLARY EMBODIMENTS

To that end, a cosmetic stamp configuration can be provided according to an exemplary embodiment of the present disclosure, which can include, e.g., a stamping element body. The exemplary stamp configuration can also include a first cosmetic stamping element removal coupled or inserted to a first side of the stamping element body, and a second cosmetic stamping element removably coupled or inserted to a second side of the stamping element body. The second side can be different and provided away from the first side. Further, at least one cosmetic component can be provided that is housed in the stamping element body.

For example, the first side can be provided opposite to the second side. The stamping element body can include a top portion rotationally coupled to a bottom portion. The first cosmetic stamping element and the second cosmetic stamping element can both be coupled to the top portion. The top portion can include a mirror, the top portion can include a first surface configured to mate with a second surface on the bottom portion, and the mirror can be located on or near the first surface. The cosmetic component(s) can be housed in the bottom portion, and/or can be removable from the bottom portion. The top portion is rotationally can be coupled to the bottom portion using at least one coupling configuration. Additionally or alternatively, the top portion can include at least one locking mechanism configured to lock the top portion to the bottom portion when the stamping element body is in a closed position. Additionally, a cosmetic holder can be provided that is situated in the bottom portion and which houses the cosmetic component(s).

According to another exemplary embodiment of the present disclosure the first cosmetic stamping element and the second cosmetic stamping element can be removably coupled to the stamping element body using an interference fit. The first cosmetic stamping element can be contoured based on an approximate shape of a right eyebrow of a person and the second cosmetic stamping element can be contoured based on an approximate shape of a left eyebrow of a person.

In still another exemplary embodiment of the present disclosure, each of the first cosmetic stamping element and the second cosmetic stamping element can comprise a handle having an opening therein, and an applicator disposed in the opening. The applicator can be composed of or include (i) foam, (ii) rubber and/or (iii) plastic. The cosmetic stamp can include an eyebrow stamp. The stamping element body can include at least one logo or at least one banner printed or etched thereon. The cosmetic component(s) can include an eyebrow powder, a mascara and/or a marker liquid.

According to a further exemplary embodiment of the present disclosure, a wall section can be provided separating the first side of the stamping element body from the second side of the stamping element body Further, the first cosmetic stamping element and the second cosmetic stamping element can be removably coupled or inserted into the first and second sides of the stamping element body, respectively, in approximately opposite directions from one another.

According to yet a further exemplary embodiment of the present disclosure, a cosmetic stamp configuration can be provide that includes a stamping element body having a top portion coupled to a bottom portion. The exemplary cosmetic stamp configuration can also include at least one cosmetic component provided in the bottom portion, and a mirror housed on the top portion. Further, the cosmetic stamp configuration can have a first cosmetic stamping element removably coupled to the top portion on a first side of the stamping element body, and a second cosmetic stamping element removably coupled to the top portion on a second side of the stamping element body. The second side can be provided on an opposite side of and at a distance away the stamping element body from the first side.

In another exemplary embodiment of the present disclosure, a method of manufacturing a cosmetic stamp configuration can be provided. For example, a top portion of a stamping element body can be coupled to a bottom portion of the stamping element body. At least one cosmetic component can be coupled into the bottom portion of the stamping element body. A first cosmetic stamping element can be inserted into a first side of the top portion. Further, a second cosmetic stamping element can be inserted into a second side of the top portion. The first side can be opposite to and provided at a distance away from the second side with respect to the stamping element body.

According to a still another exemplary embodiment of the present disclosure, a method for instructing an application of at least one cosmetic component using a cosmetic stamp configuration. The exemplary method can comprise instructing on removing a first cosmetic stamping element from a first side of a stamping element body, and instructing on removing a second cosmetic stamping elements from a second side of the stamping element body. The first side can be provided opposite to and at a distance away from the second side with respect to the stamping element body. The method also includes instructing on opening the stamping element body to reveal the at least one cosmetic component, instructing on providing the first stamping element and/or the second stamping element into the at least one cosmetic component, and instructing on applying the at least one cosmetic component using the applied first stamping element and/or the applied second stamping element.

Additionally, exemplary methods can be provided for instruct with the usage and assembly of such cosmetic stamp configuration.

These and other objects, features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Further objects, features and advantages of the present disclosure will become apparent from the following detailed description taken in conjunction with the accompanying Figures showing illustrative embodiments of the present disclosure, in which.

Figure 1:
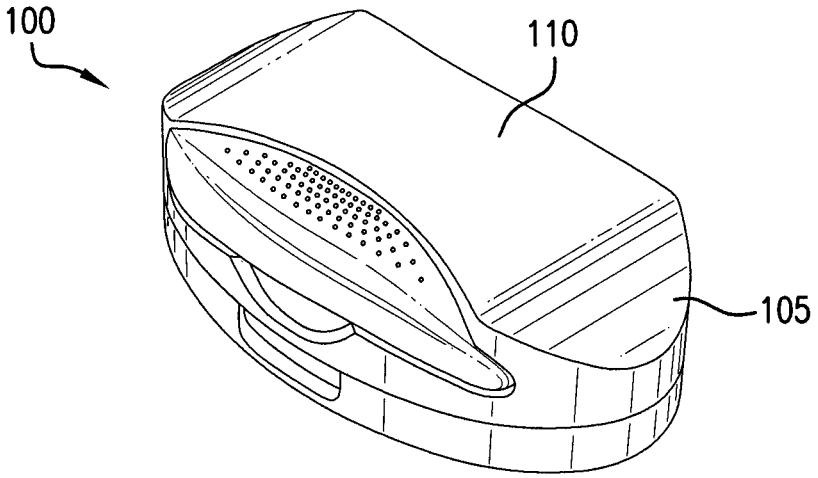
FIG. 1 is an exemplary diagram of an isometric view of the exemplary cosmetic stamp configuration according to an exemplary embodiment of the present disclosure.

Throughout the drawings, the same reference numerals and characters, unless otherwise stated, are used to denote like features, elements, components or portions of the illustrated embodiments. Moreover, while the present disclosure will now be described in detail with reference to the figures, it is done so in connection with the illustrative embodiments and is not limited by the particular embodiments illustrated in the figures and the appended claims.

DETAILED DESCRIPTION OF EXEMPLARY EMBODIMENTS

The exemplary embodiments of the present disclosure may be further understood with reference to the following description and the related appended drawings. The exemplary embodiments of the present disclosure relate to a cosmetic stamp configuration for applying various types of cosmetics to the face or other body parts of a person. For example, the exemplary cosmetic stamp configuration can be used to apply eyebrow powder, marking fluid/gel and/or mascara to the face of a person. The exemplary embodiments are described with reference to an eyebrow powder, marking fluid/gel and/or mascara, although those having ordinary skill in the art will understand that the exemplary embodiments of the present disclosure can be implemented for other cosmetics (e.g., blush, lipstick, etc.)

FIG. 1 shows an exemplary diagram of an isometric view of the exemplary cosmetic stamp configuration 100 according to an exemplary embodiment of the present disclosure. For example, cosmetic stamp configuration 100 can include a body portion 105, which can include multiple segmented portions, as described below, according to an exemplary embodiment. Body portion 105 can include, for example, a top surface 110. Top surface 110 can be smooth or textured (e.g., to improve grip of cosmetic stamp con-figuration 100), and can include writing, images, pictures and/or symbols thereon to identify particular features of cosmetic stamp configuration 100. For example, top surface 110 can include identification or trademark(s) associated with the manufacturer of cosmetic stamp configuration 100, the color or shade of the cosmetic housed in cosmetic stamp configuration 100, etc. Additionally, top surface 110 can be used to imprint advertisement, trademark, logo, etc.

Figure 2:
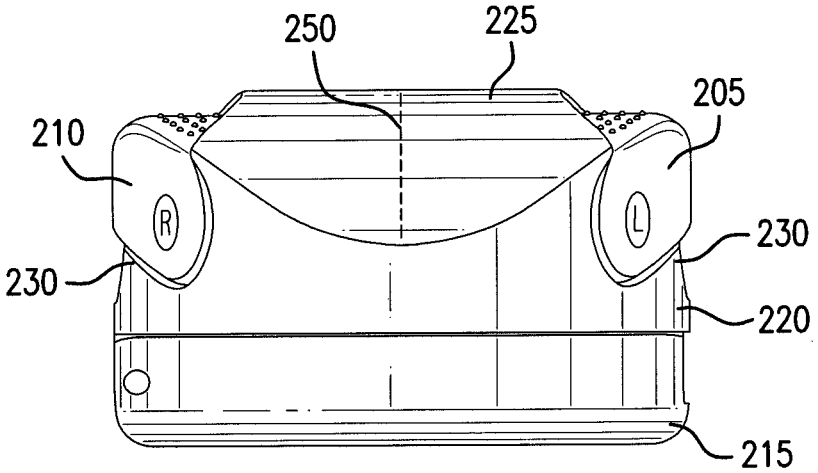
FIG. 2 is an exemplary diagram of a front view of the exemplary cosmetic stamp configuration according to an exemplary embodiment of the present disclosure.

FIG. 2 shows an exemplary diagram of a front view of the exemplary cosmetic stamp configuration 100 according to an exemplary embodiment of the present disclosure. Exemplary cosmetic stamp configuration 100 can include a bottom portion 215, which is attached to a top portion 220. Top portion 220 can include a protruding portion 225 configured to hold or otherwise maintain one or multiple stamping elements 205, 210. For example, stamping elements 205, 210 can be housed in protruding portion 225 (e.g., on the sides of protruding portion 225). As shown in FIG. 2, stamping elements 205, 210 are housed on opposite sides from one another on cosmetic stamp configuration 100. Alternatively or in addition, stamping elements 205, 210 can be housed or otherwise provided on adjacent sides of cosmetic stamp configuration 100 (e.g., stamping element 205 can be on the side of protruding portion 225 while stamping element 210 can be on the back or front of protruding portion 225). Top portion 220 can also include side extensions or lips 230, which can be used to guide stamping elements 205 and 210 into protruding portion 225. Side extensions/lips 230 can also be used to hold stamping elements 205, 210 in protruding portion 225 (e.g., using an interference fit as described below). Further exemplary detail of bottom portion 215 and top portion 220 are described below.

Figure 3:
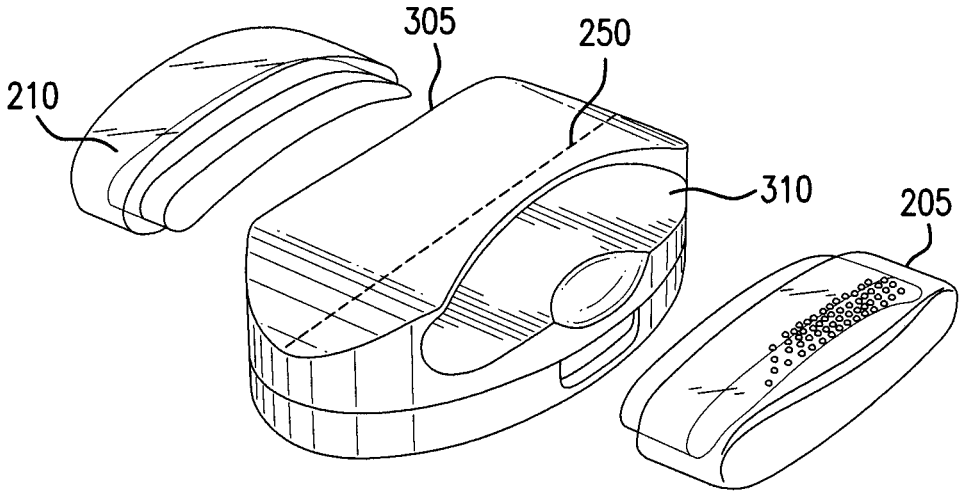
FIG. 3 is an exemplary diagram of an isometric view of the exemplary cosmetic stamp configuration according to an exemplary embodiment of the present disclosure, with the exemplary stamping elements being removed therefrom.

FIG. 3 shows an exemplary diagram of an perspective view of the exemplary cosmetic stamp configuration 100 according to an exemplary embodiment of the present disclosure. In which the stamping elements 205, 210 are provided away from cosmetic stamp configuration 100 For example, cosmetic stamp configuration 100 can include two openings 305, 310 on either side of protruding portion 225, which can be used to hold or house stamping elements 205 and 210. Openings 305, 310 can be sized to hold stamping elements 205, 210 therein (e.g., using an interference fit). These openings 205 (e.g., with the interface) can facilitate protruding portion 225 to hold stamping elements 205, 210 at various angles with respect to the plane (e.g., in a range between 150°-210°, including 160°, 170°, 180°, 190°, 200°, 210°, etc.). The interference fit can be such that a user of cosmetic stamp arrangement 100 can remove stamping elements 205, 210 using a small amount of force. With such exemplary arrangement, stamping elements 205, 210 would not accidentally fall out of cosmetic stamp configuration 100.

As shown in FIG. 3, stamping elements 205, 210 can be shaped based on the curvature or shape of a person's eyebrows, although other shapes are conceivable and are within the scope of the present disclosure. For example, stamping element 205 can be curved in one direction (e.g., a left direction) when stamping element 205 is facing a person, and/or stamping element 210 can be curved in an opposite direction (e.g., a right direction) when facing a person. The specific curve, or contour, of stamping elements 205, 210 can facilitate a superior application of eyebrow powder to the face of a person. Additionally, according to another exemplary embodiment of the present disclosure openings 305, 310 can be shaped to fit only one of stamping element 205 or stamping element 210 (e.g., stamping element 205 can fit in only one of openings 305, 310 and stamping element 210 can only fit in the other opening).

In a further exemplary embodiment of the present disclosure, a wall 250 can be provided to separate openings 305, 310 from one another, and so that stamping element 205 can be provided into opening 305 and separated from stamping element 210 when such element 210 is inserted into the opening 310. Such exemplary wall 250 can be made of plastic material to partially and/or completely separate stamping elements 205, 210 from one another. Wall can also include material to hold cosmetic composition therein such stamping elements 205, 210 can impact such material to attain additional cosmetic composition thereon.

Figure 4:
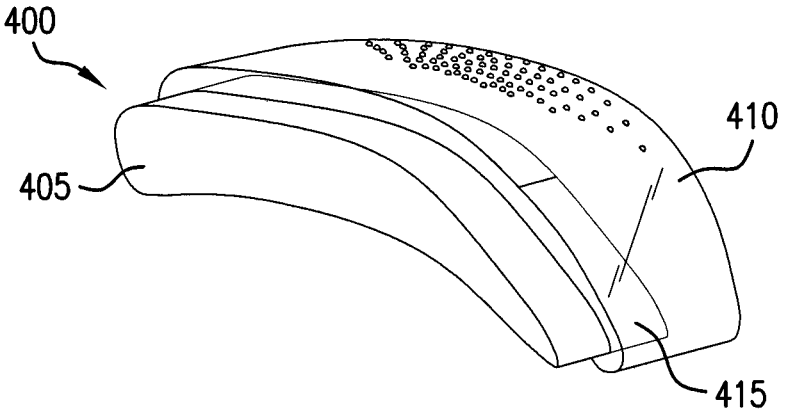
FIG. 4 is an exemplary diagram of the exemplary stamping element of the exemplary cosmetic stamp according to an exemplary embodiment of the present disclosure, a s shown in FIG. 5.

FIG. 4 shows an exemplary diagram of an exemplary stamping element 400 of the exemplary cosmetic stamp configuration 100 according to an exemplary embodiment of the present disclosure. Stamping element 400 can include a holder 410 and a removable applicator 405 housed in holder 410 (e.g., fit into holder 410). Applicator 405 can include and/or be composed of an absorptive material (e.g., a foam, rubber, plastic, or any other suitable absorptive material) in order to hold the cosmetic housed in cosmetic stamp configuration 100 to be applied to the face of a person. Exemplary stamping element 400 can include a particular contour or curve to match the contour or curve of a particular eyebrow on a person (e.g., the left eyebrow or the right eyebrow). Alternatively, stamping element can have a more general contour or curve such that it can be used on either eyebrow. Stamping element 400 can include lip or ledge 415, which can facilitate the user to hold stamping element 400 without accidentally touching applicator 405, and/or getting the cosmetic composition (e.g., powder, mascara, marker, etc.) on the user's fingers.

Figure 5:
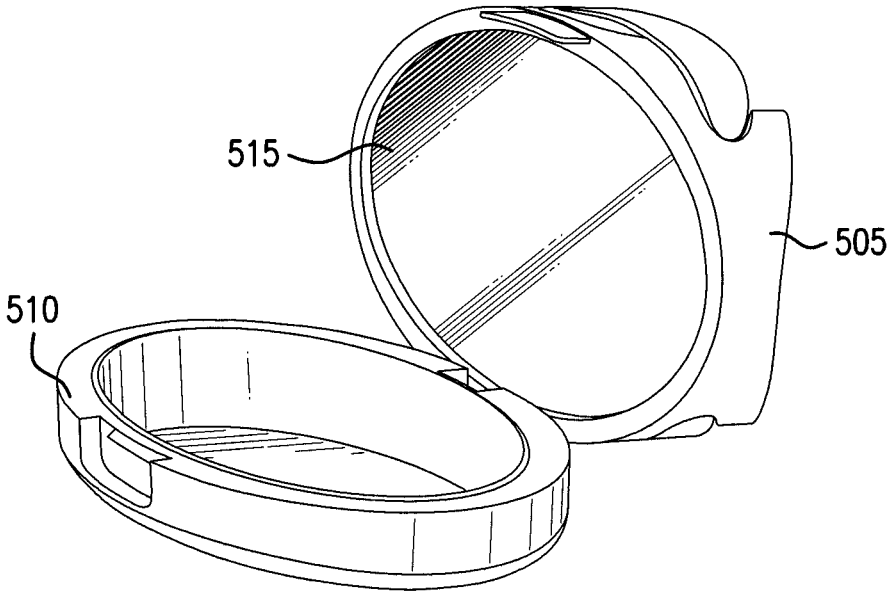
FIG. 5 is an exemplary diagram of the exemplary cosmetic stamp configuration in an open position according to an exemplary embodiment of the present disclosure.

FIG. 5 shows an exemplary diagram of the exemplary cosmetic stamp configuration 100 in an open position according to an exemplary embodiment of the present disclosure. As illustrated in FIG. 5, exemplary cosmetic stamp configuration 100 can include a top portion 505 which is rotationally coupled to a bottom portion 510 of cosmetic stamp configuration 100. Top portion 505 can include a mirror 515 housed therein to facilitate a user to view/observe, e.g., their face when such user applies the exemplary cosmetic composition.

Figure 6:
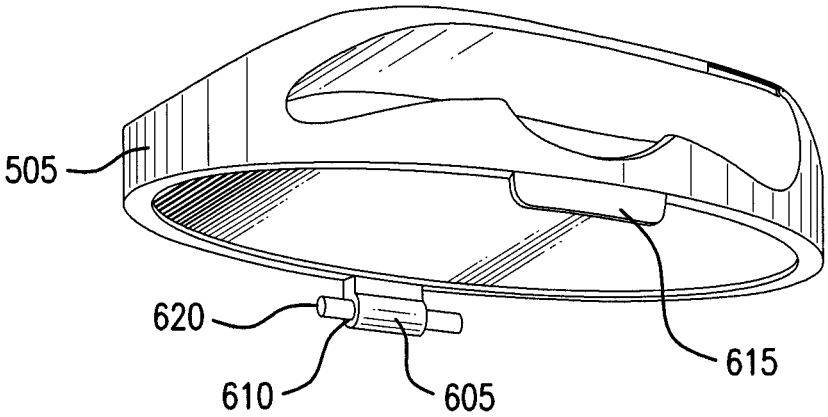
FIG. 6 is an exemplary diagram of a top portion of the exemplary cosmetic stamp according to an exemplary embodiment of the present disclosure, in a separated state from the exemplary cosmetic stamp configuration.
Figure 7:
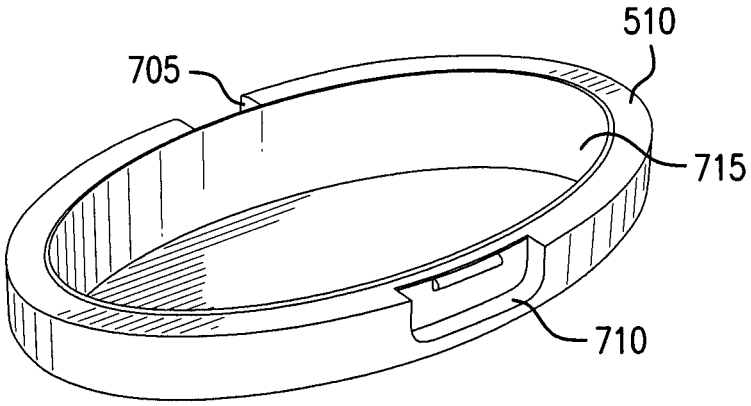
FIG. 7 is an exemplary diagram of a bottom portion of the exemplary cosmetic stamp according to an exemplary embodiment of the present disclosure, in a separated state from the exemplary cosmetic stamp configuration.

FIG. 6 illustrates an exemplary diagram of top portion 505 of the exemplary cosmetic stamp configuration 100 separated from another portion, and FIG. 7 shows an exemplary diagram of bottom portion 510 of the exemplary cosmetic stamp configuration 100 also separated from another portion, according to an exemplary embodiment of the present disclosure. Top portion 505 can include, e.g., a first connector 605, which can be configured to fit into first opening 705. For example, first connector 605 can include a bore 610 therethrough. A pin 620 can be slid or fit into bore 610. Pin 620 can be temporarily compressible, e.g., as having a spring therewith, and upon such compression, first connector 605 can be coupled to first opening 705 using pin 620. This exemplary procedure/arrangement can facilitate top portion 505 to be rotationally coupled to bottom portion 510 such that cosmetic stamp configuration 100 can be in an open position by rotating top portion 505.

As shown in FIGS. 6 and 7, top portion 505 can include second connector 615, which can be coupled, inserted and/or clipped to second opening 710 on bottom portion 510. When cosmetic stamp configuration 100 is in the closed position, second connector, clip or lock 615 can connect and/or couple to second opening 710, which can secure top portion 505 to bottom portion 510. In order to open cosmetic stamp configuration 100, the user can unclip second connector 615 and rotate top portion 505 upward and away with respect to bottom portion 510.

Figure 8:
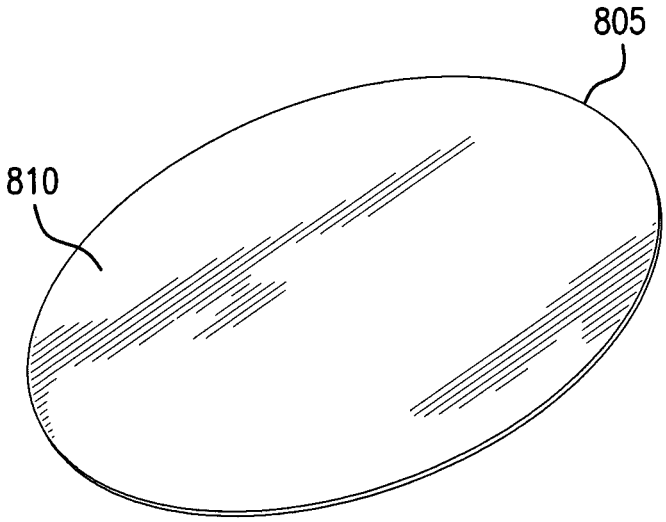
FIG. 8 is an exemplary diagram of an insert for the bottom portion of the exemplary cosmetic stamp arrangement according to an exemplary embodiment of the present disclosure.

Bottom portion 510 can also include holder 715, which can be used to hold the cosmetic composition (e.g., eyebrow powder, mascara, marker fluid, etc.) in cosmetic stamp configuration 100. For example, as shown in FIG. 8, cosmetic composition 810 can be provided on a container, sponge or other fluid maintaining arrangement 805, and such container/sponge/arrangement 805 (as well as the powder, mascara, fluid, etc. 810) can be held or otherwise maintained in holder 715. In particular, container. sponge, arrangement 805 can be placed, or installed, in holder 715 in bottom portion 510 of cosmetic stamp configuration 100. Container 805 can be removable from holder 715 such that a user can replace cosmetic 810 when cosmetic composition 810 has been used up. Container/sponge/arrangement 805 can also facilitate the user to have multiple colors of the cosmetic available for use while only using one cosmetic stamp. Alternatively or in addition, cosmetic composition 810 can be placed directly into holder 715, and may not be replaceable.

Figure 9:
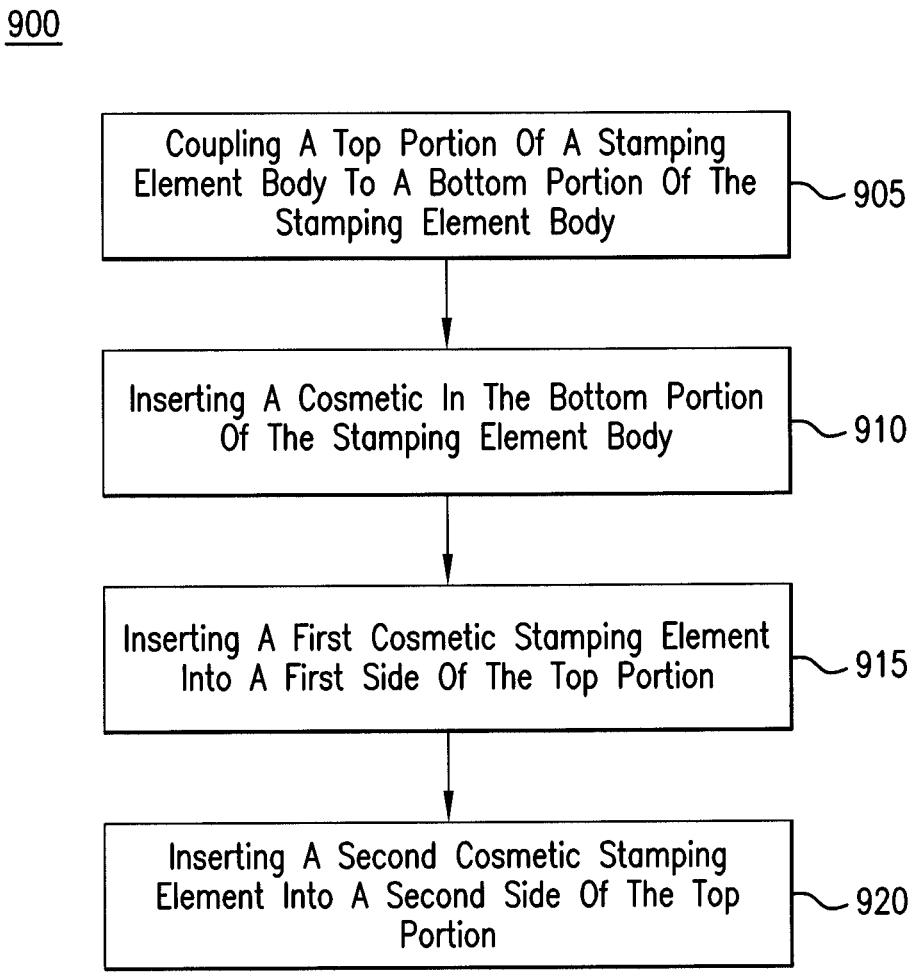
FIG. 9 is an exemplary flow diagram of an exemplary method for assembling a cosmetic stamp configuration according to an exemplary embodiment of the present disclosure.

FIG. 9 shows an exemplary flow diagram of an exemplary method 900 for assembling cosmetic stamp configuration 100 according to an exemplary embodiment of the present disclosure. For example, at procedure 905, a top portion 505 of a stamping element body can be coupled to a bottom portion 510 of cosmetic stamp configuration 100. At procedure 910, a cosmetic composition 810 can be inserted into bottom portion 510 of cosmetic stamp configuration 100. At procedure 915, a first cosmetic stamping element 205 can be inserted into a first side of top portion 505, and at procedure 920, a second cosmetic stamping element 210 can be inserted into a second side of top portion 505.

Figure 10:
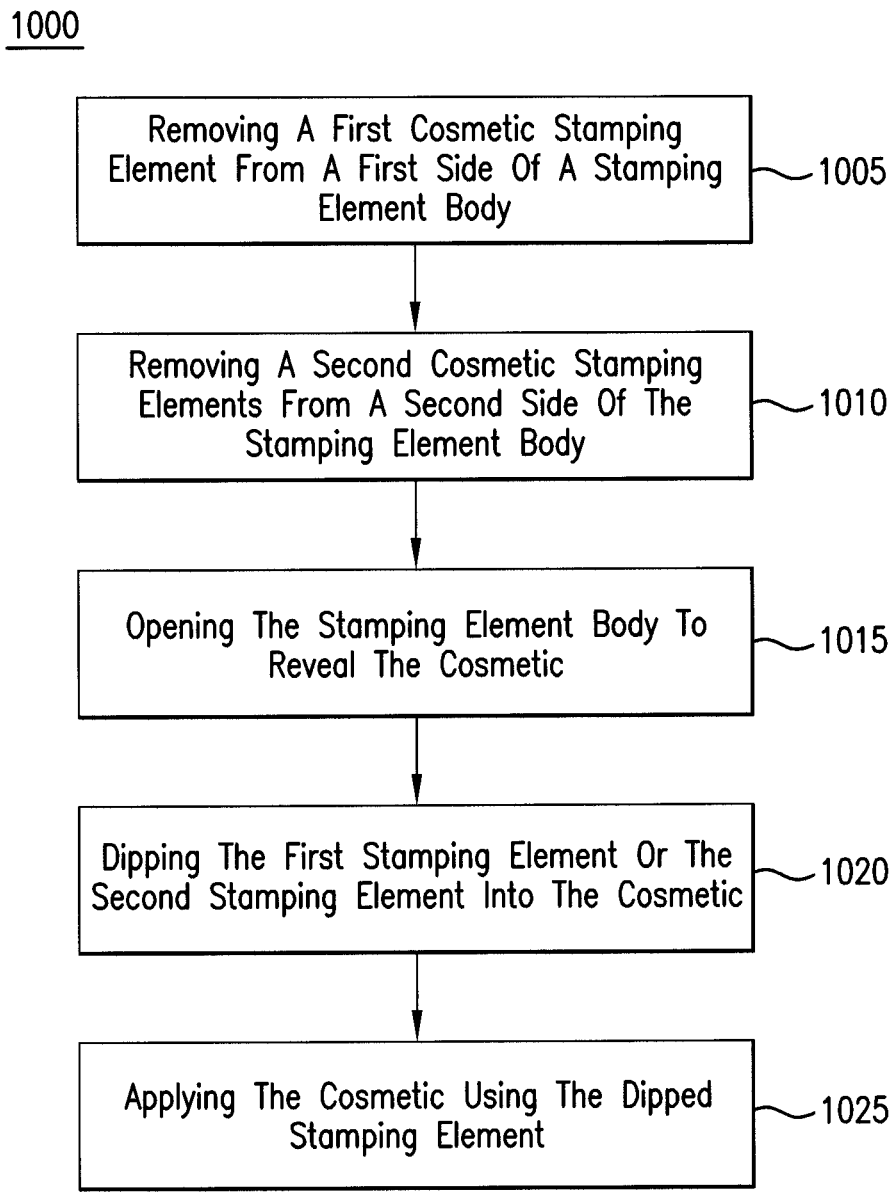
FIG. 10 is an exemplary flow diagram of an exemplary method for applying a cosmetic stamping elements using the exemplary cosmetic stamp configuration according to an exemplary embodiment of the present disclosure and/or instructing an application thereof.

FIG. 10 shows an exemplary flow diagram of an exemplary method 1000 for instructing an application of cosmetics composition 810 using the exemplary cosmetic stamp configuration 100 according to an exemplary embodiment of the present disclosure. For example, at procedure 1005, instructions can be provided for causing a first cosmetic stamping element 205 to be removed from a first side of cosmetic stamp configuration 100, and at procedure 1010, a second cosmetic stamping element 210 to be removed from a second side of cosmetic stamp configuration 100. At procedure 1015, instructions can be provided so that the stamping element body of cosmetic stamp configuration 100 can be opened to reveal a cosmetic composition 810 provided on or in container, sponge or other fluid maintaining arrangement 805. At procedure 1020, instructions can be provided so that the first stamping element 205 and/or the second stamping element 210 can be dipped into the cosmetic composition 810. At procedure 1025, instructions can be provided so that the dipped first cosmetic element 205 and/or second cosmetic element 210 can be used to apply the cosmetic composition 810 to a face of a person.

The exemplary cosmetic stamped described herein above is advantageous as it can include providing an all-in-one kit including one or more stamps and a stamping substance (e.g., a cosmetic). Other advantages include providing a product that is easy to use and configured to apply a cosmetic stamp quickly and without creating a mess. In addition, the cosmetic stamp is easy to clean and has replaceable stamps. Further, the cosmetic stamp is easily portable, can be grasped by a user using a single hand, and is easy to carry.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, and procedures which, although not explicitly shown or described herein, embody the principles of the disclosure and can be thus within the spirit and scope of the disclosure. Various different exemplary embodiments can be used together with one another, as well as interchangeably therewith, as should be understood by those having ordinary skill in the art. In addition, certain terms used in the present disclosure, including the specification, drawings and claims thereof, can be used synonymously in certain instances. It should be understood that, while words that can be synonymous to one another, can be used synonymously herein, that there can be instances when such words can be intended to not be used synonymously. Further, to the extent that the prior art knowledge has not been explicitly incorporated by reference herein above, it is explicitly incorporated herein in its entirety. All publications referenced are incorporated herein by reference in their entireties.

What is claimed is:

1. A cosmetic stamp configuration, comprising:

a stamping element body, comprising a top portion hingedly coupled to a bottom portion; a first cosmetic stamping element removably inserted to a first side of the top portion, including a first eyebrow shaped applicator;

a second cosmetic stamping element removably inserted to a second side of the top portion, including a second eyebrow shaped applicator; and at least one cosmetic component housed in the bottom portion of the stamping element body;

wherein the first applicator and second applicator are opposed to and are configured to face each other when each of the first and second cosmetic stamping elements are inserted to the stamping element body;

wherein a bottom surface of the top portion comprises a mirrored surface.

2. The cosmetic stamp of claim 1, wherein the at least one cosmetic component is removable from the bottom portion.

3. The cosmetic stamp of claim 1, wherein the top portion is rotationally coupled to the bottom portion using at least one coupling configuration.

4. The cosmetic stamp of claim 1, wherein the top portion includes at least one locking mechanism con figured to lock the top portion to the bottom portion when the stamping element body is in a closed position.

5. The cosmetic stamp of claim 1, further comprising a cosmetic holder situated in the bottom portion and which houses the at least one cosmetic component.

6. The cosmetic stamp of claim 1, wherein the frictional engagement is an interference fit.

7. The cosmetic stamp of claim 1, wherein the applicator is composed of at least one of (i) foam, (ii) rubber, or (iii) plastic.

8. The cosmetic stamp of claim 1, wherein each of the first cosmetic stamping element and the second cosmetic stamping element comprises a handle having an opening therein, and wherein a corresponding one of the first and second applicators is disposed in the opening.

9. The cosmetic stamp of claim 1, wherein the stamping element body includes at least one logo or at least one banner printed or etched thereon.

10. The cosmetic stamp of claim 1, wherein the at least one cosmetic component includes at least one of an eyebrow powder, a mascara or a marker liquid.

11. The cosmetic stamp of claim 1, further comprising a wall section separating the first side of the stamping element body from the second side of the stamping element body.

12. The cosmetic stamp of claim 1, wherein the first cosmetic stamping element is held by the stamping element body at a first angle relative to a horizontal plane and the second cosmetic stamping element is held by the stamping element body at a second angle relative to the horizontal plane; and each of the first angle and the second angle is in a range between 150° and 210°.

13. A cosmetic stamp, comprising:

a stamping element body having a top portion coupled to a bottom portion;

the top portion comprising a top surface extending from a first side to a second side, a peripheral side surface and a mirrored bottom surface; the peripheral side surface further comprising opposing first and second cavities on respective first and second sides of the body;

at least one cosmetic component provided in the bottom portion;

first and second cosmetic stamping elements removably and fixedly coupled to respective opposing first and second cavities such that when coupled, the first and second stamping elements face one another;

wherein each of the first and second cosmetic stamping elements comprise a respective cosmetic applicator extending from a bolder that is configured to correspond in shape both to a shape of the respective cavity to which it is to be coupled and to a shape of cosmetic that is to be applied to a user.

14. A method of manufacturing a cosmetic stamp configuration, comprising:

hingedly coupling a top portion of a stamping element body of a cosmetic stamp configuration to a bottom portion of the stamping element body;

inserting at least one cosmetic component into the bottom portion of the stamping element body;

inserting a first cosmetic stamping element including a first eyebrow shaped applicator into a first side of the top portion; and inserting a second cosmetic stamping element including a second eyebrow shaped applicator into a second side of the top portion, wherein the first side is opposite to and at a distance away from the second side with respect to the stamping element body, and the first applicator and second applicator are opposed to each other when each of the first and second cosmetic stamping elements are coupled or inserted to the stamping element body;

wherein a bottom surface of the top portion comprises a mirrored surface.

15. A method for applying at least one cosmetic component using a cosmetic stamp configuration, comprising:

instructing on applying force in order to remove a first cosmetic stamping element of a cosmetic stamp configuration, which includes a first applicator and is inserted into a first side of a bottom portion of a stamping element body, from the first side of the bottom portion of the stamping element body;

instructing on applying force in order to remove a second cosmetic stamping element of the cosmetic stamp configuration, which includes a second applicator and is inserted into a second side of the bottom portion of the stamping element body, from the second side of the bottom portion of the stamping element body, wherein the first side is opposite to and at a distance away from the second side with respect to the stamping element body, and the first applicator and second applicator are configured to face each other when each of the first and second cosmetic stamping elements are coupled or inserted to the stamping element body;

instructing on opening a top portion of the stamping element body to reveal at least one cosmetic component; wherein the top portion is hingedly coupled to the bottom portion and wherein a bottom surface of the top portion comprises a mirrored surface;

instructing on providing at least one of the first stamping element or the second stamping element into the at least one cosmetic component; and instructing on applying the at least one cosmetic component using the at least one of the applied first stamping element or the applied second stamping element.

* * * * *